US006474840B2

(12) United States Patent
Padermos

(10) Patent No.: US 6,474,840 B2
(45) Date of Patent: Nov. 5, 2002

(54) CHRISTMAS DECORATIVE LIGHTING CONCEALING DEVICE

(76) Inventor: Robin B. Padermos, 6604 Constitution Dr., Watauga, TX (US) 76148

( * ) Notice: Subject to any disclaimer, the term of this patent is extended or adjusted under 35 U.S.C. 154(b) by 0 days.

(21) Appl. No.: 09/752,312

(22) Filed: Jan. 2, 2001

(65) Prior Publication Data

US 2002/0085380 A1 Jul. 4, 2002

(51) Int. Cl.[7] ..... F21V 21/00
(52) U.S. Cl. ..... 362/249; 362/147; 362/374
(58) Field of Search ..... 362/145, 248, 362/249, 374, 240, 391, 225, 147, 375, 806, 396

(56) References Cited

U.S. PATENT DOCUMENTS 4,128,863 A 12/1978 Premetz
4,155,111 A * 5/1979 Kelly ..... 362/374
5,311,414 A 5/1994 Branham, Sr.
5,816,687 A * 10/1998 Tapp ..... 362/250
5,957,568 A 9/1999 Byers
6,224,232 B1 * 5/2001 Rodriguez ..... 362/145
6,273,380 B1 * 8/2001 Fillipp et al. ..... 248/231.91

* cited by examiner

*Primary Examiner*—Sandra O'Shea
*Assistant Examiner*—Ali Alari
(74) *Attorney, Agent, or Firm*—Randal D. Homburg

(57) ABSTRACT

The invention is a device attaching to a building structure wherein decorative seasonal lighting may be installed, the device having a front cover member which conceals and protects the installed seasonal lighting when the user deems it inappropriate to display such lighting, so that such installed seasonal lighting does not need to be removed from the building structure.

6 Claims, 2 Drawing Sheets

CHRISTMAS DECORATIVE LIGHTING CONCEALING DEVICE

CROSS REFERENCE TO RELATED APPLICATIONS

None

BACKGROUND OF THE INVENTION

1. Field of Invention

The invention is a device attaching to a building structure wherein decorative seasonal lighting may be installed, the device having a front cover member which conceals and protects the installed seasonal lighting when the user deems it inappropriate to display such lighting, so that such seasonal lighting does not need to be removed from the building structure.

2. Description of Prior Art

The following United States patents were discovered and are disclosed within this application for utilitypatent. All relate to varied lighting devices. In U.S. Pat. No. 5,311,414 to Branham, Sr., a Christmas light mounting device is disclosed having a V-shaped cover plate hinge mounted to a planar cover plate, a rear wall mounted to the eave of a house, the rear plate containing a plurality of bulb sockets, the V-shaped plate allowing the illuminated bulb to be displayed through such cover.

A device having a hinged light mounting board is disclosed in U.S. Pat. No. 4,128,863 to Premetz, having the mounting board hinged to the edge of a house with the entire device pivoting out of view under the edge of the house, the lights affixed to the pivoting board. U.S. Pat. No. 5,957,568 to Byers discloses a tracked light system for mounting to a surface in a variety of methods, the invention including a snap on cover attaching to the light track to cover the illuminated view allowing the light to shine through such cover.

SUMMARY OF THE INVENTION

The primary objective of the invention is to provide a device to allow for a one-time attachment of the device to a building structure wherein strands of decorative lighting may be installed, the invention having a hinged cover over the lighting to protect the lighting from the off-season elements, in climate weather, birds, insects and leaves. This cover is also provided to temporarily block illumination of the contained lighting in lieu of disconnecting the power source.

DESCRIPTION OF THE DRAWINGS

The following drawings are submitted with this utility patent application.

DESCRIPTION OF THE PREFERRED EMBODIMENTS

Figure 1:
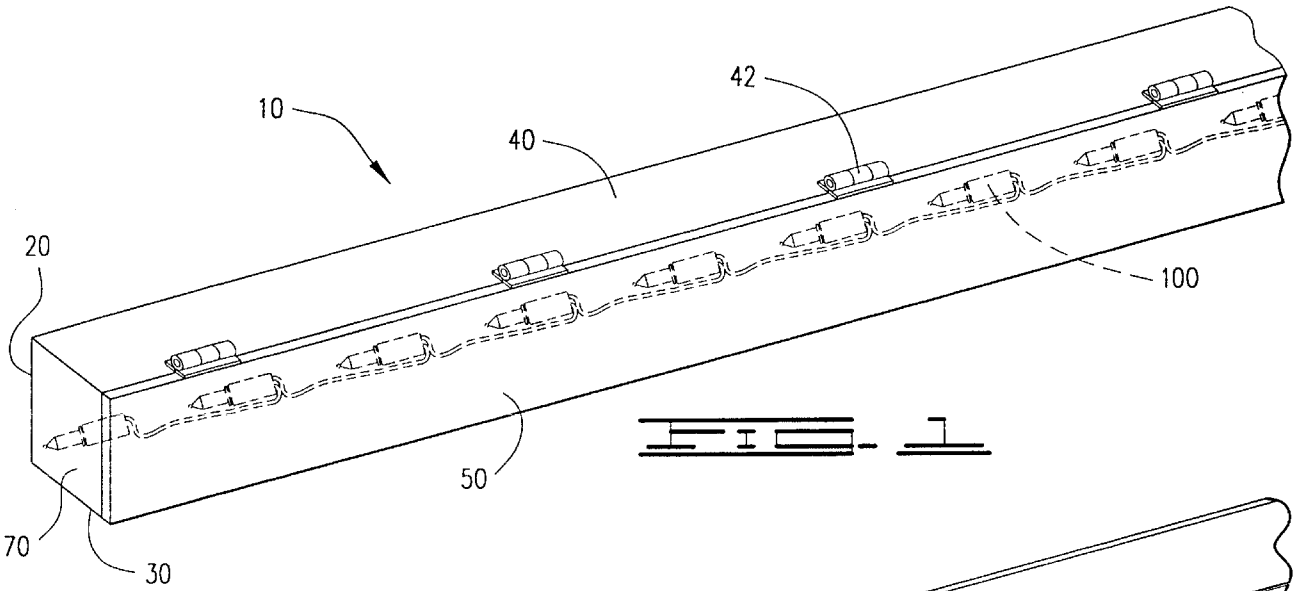
FIG. 1 is a perspective view of the invention with the hinged front cover in a lowered position.
Figure 2:
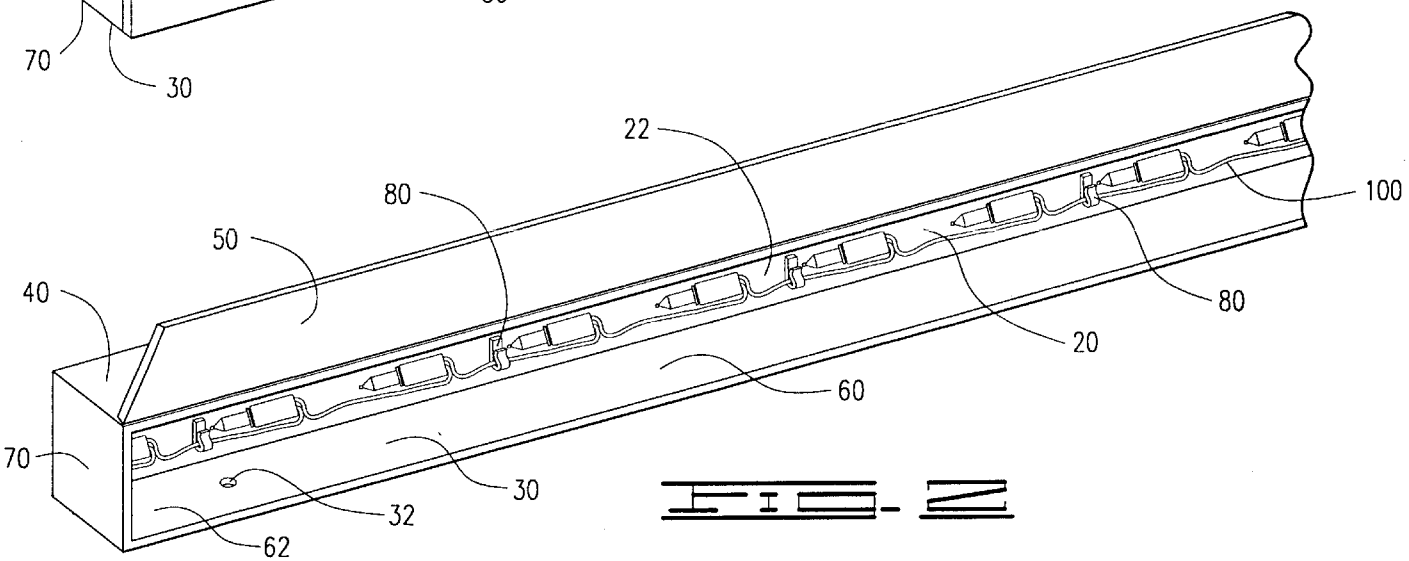
FIG. 2 is a perspective view of the invention with the hinged front cover raised.

The invention 10 is a decorative lighting display device for the installation and display of seasonal lighting, as shown in FIGS. 1–4 of the drawings, the invention 10 comprising a rear panel 20, a bottom panel 30, a top panel 40, and a hinged front cover 50. The rear panel 20 has a front surface 22, a rear surface 24, an upper edge 26 and a lower edge 28. The bottom panel 30 attaches to the lower edge 28 of the rear panel 20, while the top panel 40 attaches to the upper edge 26 of the rear panel 20. The hinged front cover 50 is attached to the top panel 40 by at least two hinges 42, the hinged front cover 50 extending from the top panel 40 to the bottom panel 30 when the hinged front cover 50 is in a lowered position. The rear panel 20, bottom panel 30, top panel 40, and hinged front cover 50 form a linear cavity 60, such linear cavity 60 having two ends 62. End caps 70 are provided with the invention which may be installed in the two ends 62 of the linear cavity 60 to enclose the linear cavity 60 from outside the invention 10.

Figure 3:
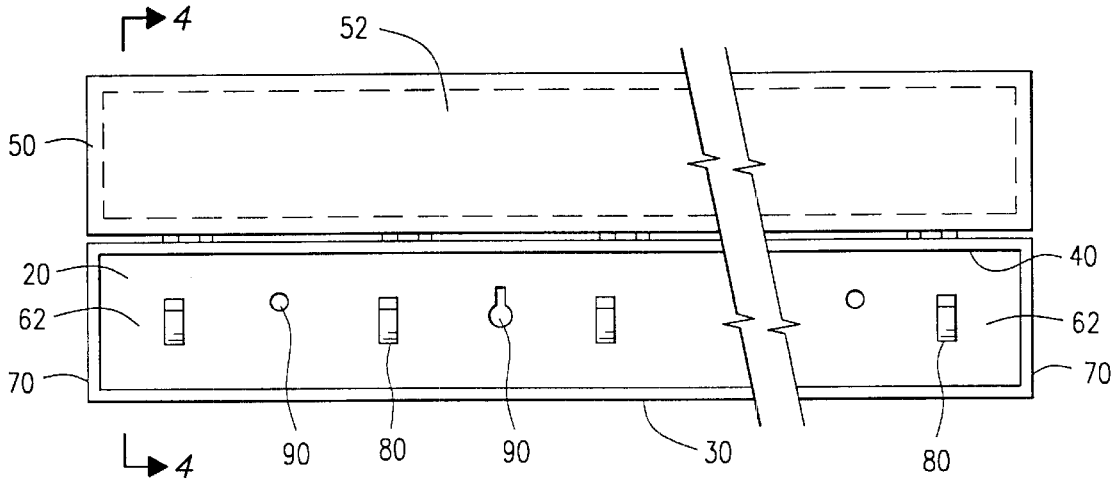
FIG. 3 is a front view of the invention with the hinged front cover raised.
Figure 4:
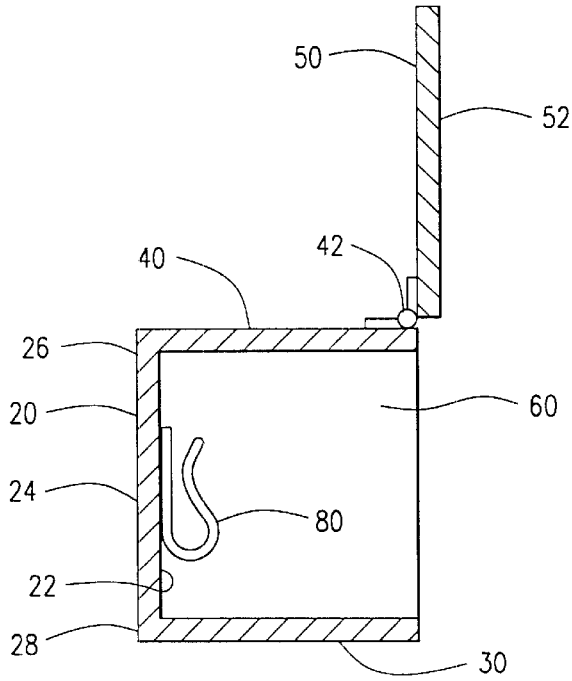
FIG. 4 is a side view of the invention

The front surface 22 of the rear panel 20, as shown in FIGS. 3 and 4 of the drawings of the invention has a plurality of spaced hooks 80 which secure a strand of decorative lighting 100 against the front surface 22 of the rear panel 20. At least one hole 32 is provided in the bottom panel 30 to allow access of the strand of lights 100 to an electrical power source for illumination. In various embodiments, the hinged front cover 50 has a plurality of interchangeable front panels 52 of varied color and transparency, the appropriate front panel 52 selected by the user.

The invention may be installed on an eave of a house or against a flat wall surface, the invention being attached with the rear surface 24 of the rear panel 20 attaching to the eave of the house or against the flat wall surface through fastening holes 90 provided in the rear panel 20. In another embodiment, the invention may be attached to the soffit or underside surface of the eave of a house by attaching the upper panel of the invention to the soffit or underside surface of the eave of a house, provided that such attachment does not affect the ability of the hinged front cover 50 to be raised and lowered.

Once the invention is installed, the strands of lights 100 are attached to the plurality of spaced hooks 80. Several of the inventions may be installed together with the linear cavities 60 of the inventions connected for the continuation of multiple strands of lights 100, placing end caps 70 only on the ends 62 of the invention not connected to another invention. The material comprising the invention may be of a flexible or slightly deformable material allowing the invention to be installed on an irregularly shaped surface. In addition, the plurality of spaced hooks 80 may be provided in decorative patterns, causing the secured strands of lights 100 to form shapes, designs, patterns or verbal messages.

As disclosed, the invention may be used as a permanent installation for seasonal lighting, allowing for a one-time installation of the invention and the strands of lights 100, with the hinged front cover 50 lowered, protecting the linear cavity 60 from weather, insects and birds. The hinged front cover 50 may be lifted for clear display of the illuminated strands of lights 100, and lowered to prevent the illumination from display, in the event that the installed front panel 52 is opaque.

While the invention has been particularly shown and described with reference to a preferred embodiment thereof, it will be understood by those skilled in the art that changes in form and detail may be made therein without departing from the spirit and scope of the invention.

What is claimed is:

1. A decorative lighting display device for the installation and display of seasonal lighting, the device comprising:

a. a rear panel having a front surface, a rear surface, an upper edge and a lower edge and a plurality of spaced hooks securing strands of lights against the front surface;

b. a bottom panel attached to the lower edge of the rear panel;

c. a top panel attached to the upper edge of the rear panel; and d. a hinged front cover attached to the top panel by at least two hinges, the hinged front cover extending from the top panel to the bottom panel when the hinged front cover is in a lowered position, which, with the inclusion of the rear panel, forms a linear cavity having two ends, the rear surface of the rear panel attaching to the side of a building.

2. The device of claim 1 wherein the bottom panel includes at least one hole to allow access of the secured strand of lights to an electrical power source.

3. The device of claim 1 wherein the hinged front cover has a plurality of interchangeable front panels of varied color and transparency.

4. The device of claim 1, further comprising end caps which may be installed in the ends of the linear cavity to close the linear cavity from outside the device.

5. The device of claim 1, wherein several of the devices are installed together with the linear cavities of the several devices connected for the continuation of multiple strands of lights.

6. The device of claim 1, wherein the plurality of spaced hooks are provided in decorative patterns, the secured strands of lights forming shapes, designs, patterns and verbal messages.

* * * * *